US008753564B2

(12) United States Patent
Beaulieu

(10) Patent No.: US 8,753,564 B2
(45) Date of Patent: Jun. 17, 2014

(54) PISTON ROD AND CYLINDER SEAL DEVICE FOR ALUMINUM BATH CRUST BREAKER

(75) Inventor: Gilles Beaulieu, Trois-Rivieres (CA)

(73) Assignee: MAC Valves, Inc., Wixom, MI (US)

( * ) Notice: Subject to any disclaimer, the term of this patent is extended or adjusted under 35 U.S.C. 154(b) by 292 days.

(21) Appl. No.: 13/159,061

(22) Filed: Jun. 13, 2011

(65) Prior Publication Data

US 2012/0313302 A1 Dec. 13, 2012

(51) Int. Cl.
*C22B 9/00* (2006.01)
*F15B 15/22* (2006.01)

(52) U.S. Cl.
CPC ..... *F15B 15/223* (2013.01)
USPC ..... 266/287; 92/85 R; 92/168

(58) Field of Classification Search
USPC ..... 266/287, 44, 90; 277/434, 457; 204/245, 243.1, 247.1; 92/13.1, 173, 92/13.4, 172–230, 85 B, 168, 165 R; 91/403, 392; 173/204, 47, 168
See application file for complete search history.

(56) References Cited

U.S. PATENT DOCUMENTS

| | | | | |
|---|---|---|---|---|
| 3,095,786 | A * | 7/1963 | Fenton | 91/454 |
| 3,400,062 | A | 9/1968 | Bruno et al. | |
| 3,620,126 | A | 11/1971 | Fuhrimann | |
| 3,660,256 | A | 5/1972 | Lippitt et al. | |
| 4,606,257 | A * | 8/1986 | Pfister | 91/27 |
| 4,680,930 | A | 7/1987 | Dollison | |
| 4,700,612 | A | 10/1987 | Pfister | |
| 4,932,311 | A * | 6/1990 | Mibu et al. | 91/361 |
| 5,542,336 | A | 8/1996 | Larkin | |
| 5,735,187 | A * | 4/1998 | Harju | 91/44 |
| 5,944,045 | A | 8/1999 | Allen et al. | |
| 6,408,740 | B1 | 6/2002 | Holt et al. | |
| 6,436,270 | B1 | 8/2002 | Sander | |
| 6,776,081 | B2 | 8/2004 | Casinge et al. | |
| 7,429,314 | B2 | 9/2008 | Couvreur et al. | |

(Continued)

FOREIGN PATENT DOCUMENTS

| | | |
|---|---|---|
| CA | 2675697 | 8/2008 |
| WO | WO 2007-042780 | 4/2007 |
| WO | WO 2011-060876 | 5/2011 |

OTHER PUBLICATIONS

International Search Report for International Application No. PCT/US2012/042035 mailed Jan. 25, 2013.

(Continued)

*Primary Examiner* — Scott Kastler
*Assistant Examiner* — Michael Aboagye
(74) *Attorney, Agent, or Firm* — Harness, Dickey & Pierce, P.L.C.

(57) ABSTRACT

A piston rod and cylinder seal device includes a cylinder defining a piston chamber extending between first and second cylinder heads. The second cylinder head has a spud receiving bore, a pressure passage communicating with the spud receiving bore, and a bore supply/vent passage. A piston is disposed in the piston chamber. A piston rod is connected to the piston having a piston rod spud including a shaft receiving bore. A tubular shaft connected to the second cylinder head in the spud receiving bore has a passage communicating with the bore supply/vent passage. The shaft is sealingly received in the shaft receiving bore when the piston rod spud is received in the spud receiving bore preventing pressurized air in the bore supply/vent passage from entering the spud receiving bore. The shaft is positioned outside the shaft receiving bore when the piston rod spud is outside the spud receiving bore.

15 Claims, 7 Drawing Sheets

(56) References Cited

U.S. PATENT DOCUMENTS

| | | | | |
|---|---|---|---|---|
| 7,892,319 | B2 | 2/2011 | Massaro et al. | |
| 2002/0170819 | A1 | 11/2002 | Horstmann et al. | |
| 2007/0186763 | A1 | 8/2007 | Weiler, Jr. et al. | |
| 2009/0078110 | A1 * | 3/2009 | Waldmann et al. | 91/403 |
| 2009/0308721 | A1 | 12/2009 | Beaulieu | |
| 2012/0292834 | A1 | 11/2012 | Palsson | |

OTHER PUBLICATIONS

Written Opinion of the International Searching Authority for International Application No. PCT/US2012/042035 mailed Jan. 25, 2013.

International Search Report for International Application No. PCT/US2012/042026 mailed Feb. 26, 2013.

Written Opinion of the International Searching Authority for International Application No. PCT/US2012/042026 mailed Feb. 26, 2013.

Verreault, J., et al., "Retrofit of a Combined Breaker Feeder with a Chisel Bath Contact Detection System to Reduce Anode Effect Frequency in a Potroom." in: Light Metals 2011 (Edited by: Stephen J. Lindsay) TMS (The Minerals, Metals & Materials Society), 2011, pp. 467-470.

* cited by examiner

PISTON ROD AND CYLINDER SEAL DEVICE FOR ALUMINUM BATH CRUST BREAKER

FIELD

The present disclosure relates to seal devices used in pneumatic control systems for operating metal processing baths.

BACKGROUND

This section provides background information related to the present disclosure which is not necessarily prior art.

Known systems used to control operations of metal processing baths such as for aluminum processing can include pneumatic valves and piping used to drive a crust breaking tool to create an aperture by breaking through the hardened upper crust layer formed on the bath. The crust breaking tool is intended to open the aperture to permit addition of additional alumina material to the molten bath of aluminum. When creation of the aperture has been confirmed, pressurized air directs the crust breaking tool to retract from the crust layer. The drawbacks of such systems include the large volumes of pressurized air which are used to control a normal crust breaking operation, and particularly when crust material forms on the crust breaking tool such that bath detection cannot occur, and/or when the crust breaking tool cannot penetrate the crust layer.

In these situations, the crust breaking tool can remain in the bath for an undesirable length of time which can damage the crust breaking tool, or render the detection system inoperative. Also in these situations, the subsequent feeding of new alumina material into the bath can be hindered, or the system may be unable to identify how many feed events have occurred, thus leading to out-of-range conditions in the bath. A further drawback of known control systems is the large volume of high pressure air required significantly increases operating costs of the system due to the size and volume of high pressure air system requirements, power consumption and cost, the operating time of pumps/compressors, and the number of air compressors and air dryers required for operation.

SUMMARY

This section provides a general summary of the disclosure, and is not a comprehensive disclosure of its full scope or all of its features.

According to several embodiments of a piston rod and cylinder seal device for an aluminum bath crust breaker, a crust breaker device includes a cylinder defining a piston chamber extending between opposed first and second cylinder heads. A piston is slidably disposed in the piston chamber. A piston rod is connected to the piston. A piston rod spud extends from the piston rod including a shaft receiving bore having a first seal member in the shaft receiving bore. A hollow tubular shaft is connected to the second cylinder head. The shaft is aligned to be slidingly received in the shaft receiving bore and sealed by contact with the first seal member when the piston contacts the second cylinder head.

According to other embodiments, a crust breaker device includes a cylinder defining a piston chamber extending between first and second cylinder heads. The second cylinder head has a spud receiving bore, a pressure passage communicating with the spud receiving bore, and a bore supply/vent passage. A piston is slidably disposed in the piston chamber. A piston rod is connected to the piston having a piston rod spud including a shaft receiving bore. A hollow tubular shaft connected to the second cylinder head in the spud receiving bore has a central passage communicating with the bore supply/vent passage. The shaft is sealingly received in the shaft receiving bore when the piston rod spud is received in the spud receiving bore preventing pressurized air in the bore supply/vent passage from entering the spud receiving bore. The shaft is positioned outside the shaft receiving bore when the piston rod spud is outside the spud receiving bore.

According to further embodiments, a crust breaker system includes a cylinder defining a piston chamber having a cylinder head. The cylinder head has a spud receiving bore, a pressure passage communicating with the spud receiving bore, and a bore supply/vent passage. A piston is slidably disposed in the piston chamber. A piston rod is connected to the piston, the piston rod having a piston rod spud including a shaft receiving bore. A hollow tubular shaft is connected to the cylinder head and positioned in the spud receiving bore. The shaft is sealingly received in the shaft receiving bore of the piston rod spud when the piston rod spud is slidingly received in the spud receiving bore thereby isolating the bore supply/vent passage communicating pressurized air to the shaft from the pressure passage communicating with the spud receiving bore. The shaft is positioned outside of the shaft receiving bore when the piston rod spud is outside of the spud receiving bore. A pneumatic valve system includes a first control valve; and a valve position control line connecting the first control valve to the pressure passage.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings. For simplification, not all parts are shown in all views of the drawings.

DETAILED DESCRIPTION

Example embodiments will now be described more fully with reference to the accompanying drawings.

Figure 1:
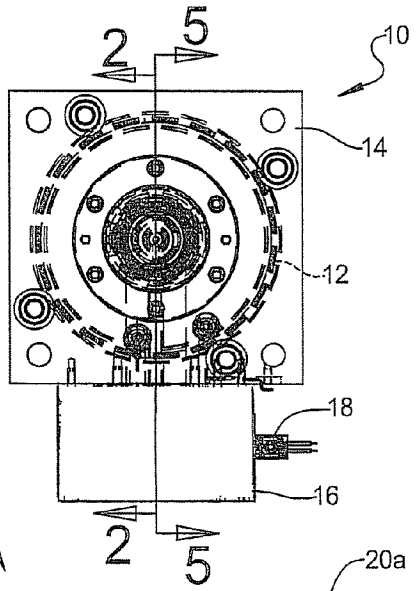
FIG. 1 is an end elevational view of an aluminum bath crust breaker device having a piston rod and cylinder seal device of the present disclosure.

Referring to FIG. 1, a piston rod and cylinder sealing device 10 includes a cylinder 12 enclosed by a first cylinder head 14 defining a first end of cylinder 12. A control portion 16 having one or more sensor connectors 18 extending therefrom is also provided with piston rod and cylinder sealing device 10.

Figure 2:
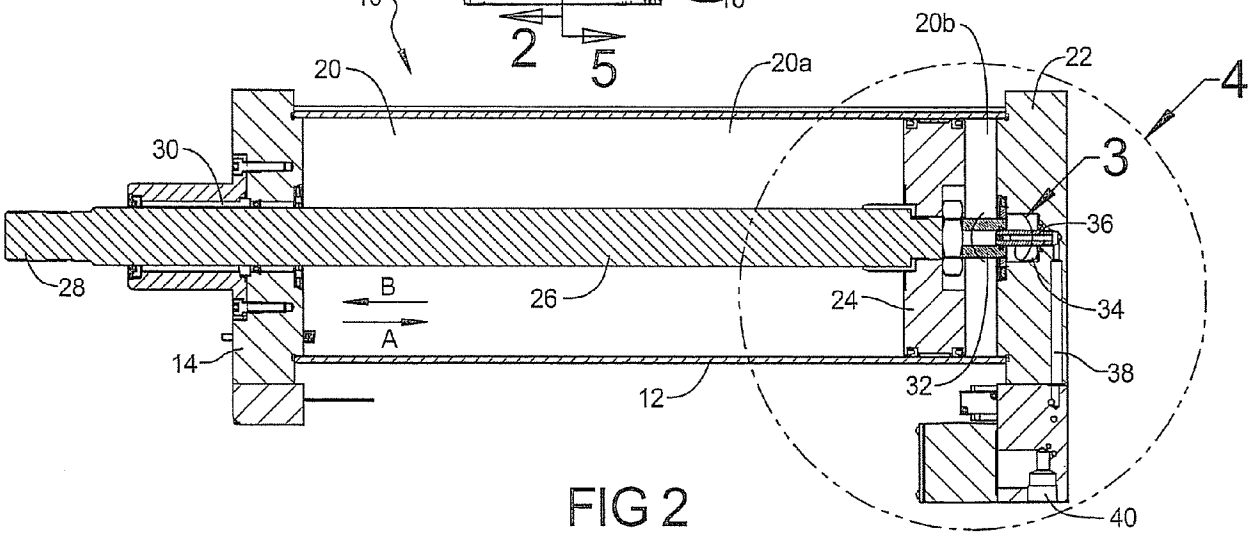
FIG. 2 is a cross sectional front elevational view taken at section 2 of FIG. 1.

Referring to FIG. 2, cylinder 12 defines a piston chamber 20 and further includes a second cylinder head 22 creating a second end of cylinder 12. Control portion 16 can be connected to second cylinder head 22. A piston 24 is slidably disposed within piston chamber 20 such that piston chamber 20 is divided into a first portion 20*a* on a first side of piston 24 and a second portion 20*b* on a second side of piston 24.

Piston 24 is connected to a piston rod 26 which can include a crust breaker rod 28 connected to piston rod 26, or forming a free end of piston rod 26. Piston rod 26 extends through first cylinder head 14 and is slidably disposed using a rod bearing/seal 30 such that pressure within piston chamber 20 is contained by rod bearing/seal 30. At an opposite end of piston rod 26 is provided a piston rod spud 32 which is slidingly disposed in a spud receiving bore 34 when the piston 24 contacts second cylinder head 22.

A hollow tubular shaft 36 is connected to second cylinder head 22 and is slidably received within piston rod spud 32 when piston rod spud 32 slidingly enters spud receiving bore 34. A fluid pressure such as pressurized air can be introduced through hollow tubular shaft 36 from a bore supply/vent passage 38 created in second cylinder head 22. A pressure supply/vent port 40 is also provided with second cylinder head 22. Air pressure supplied at pressure supply/vent port 40 can be directed into spud receiving bore 34.

Figure 3:
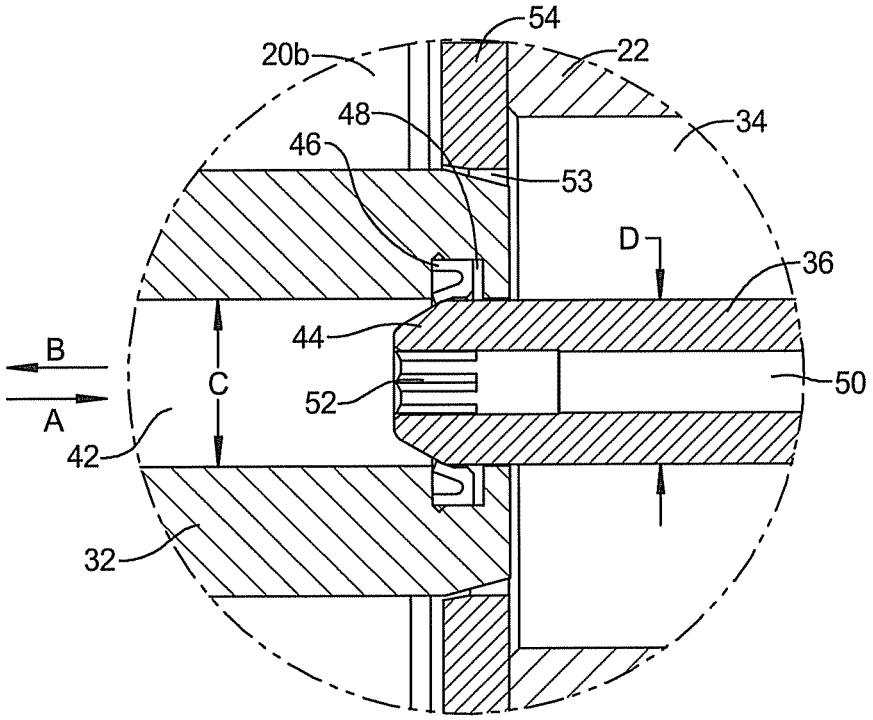
FIG. 3 is a cross sectional front elevational view taken at area 3 of FIG. 2.

Referring to FIG. 3, piston rod spud 32 includes a blind shaft receiving bore 42 which is sized having a spud bore diameter "C" adapted to slidingly receive a shaft diameter "D" of tubular shaft 36. When a shaft free end 44 of tubular shaft 36 is initially received in shaft receiving bore 42, the outer perimeter wall defining shaft diameter "D" contacts a first seal member 46 which is positioned in a seal slot 48 of piston rod spud 32. Continued displacement of piston rod spud 32 in the piston return direction "A" provides continuous sealing contact between tubular shaft 36 and first seal member 46 throughout the length of tubular shaft 36. Tubular shaft 36 also provides a central passage 50 extending throughout a total length of tubular shaft 36. Central passage 50 therefore communicates with shaft receiving bore 42 of piston rod spud 32, therefore permitting fluid such as compressed air in shaft receiving bore 42 to displace in the piston return direction "A" as piston rod spud 32 moves in the piston return direction "A". According to several embodiments, a means for installing tubular shaft 36 is provided such as the provision of a plurality of wrench engagement flats 52 which are positioned proximate to shaft free end 44 and within central passage 50. Wrench engagement flats 52 can be engaged by a tool (not shown) such as a wrench used to rotate and therefore install tubular shaft 36.

It is further noted that an annular passage 53 is provided between piston rod spud 32 and a cushion seal ring 54 which is connected to second cylinder head 22. A sliding clearance is provided between piston rod spud 32 and cushion seal ring 54. Cushion seal ring 54 as known in the art allows pressurized fluid such as pressurized air in second portion 20*b* of piston chamber 20 to pass from second portion 20*b* into spud receiving bore 34 as the piston 24 and piston rod spud 32 both travel in the piston return direction "A". During pressurized operation, annular passage 53 also provides an opposite passageway for compressed or pressurized air to pass between spud receiving bore 34 and into second portion 20*b*.

Figure 4:
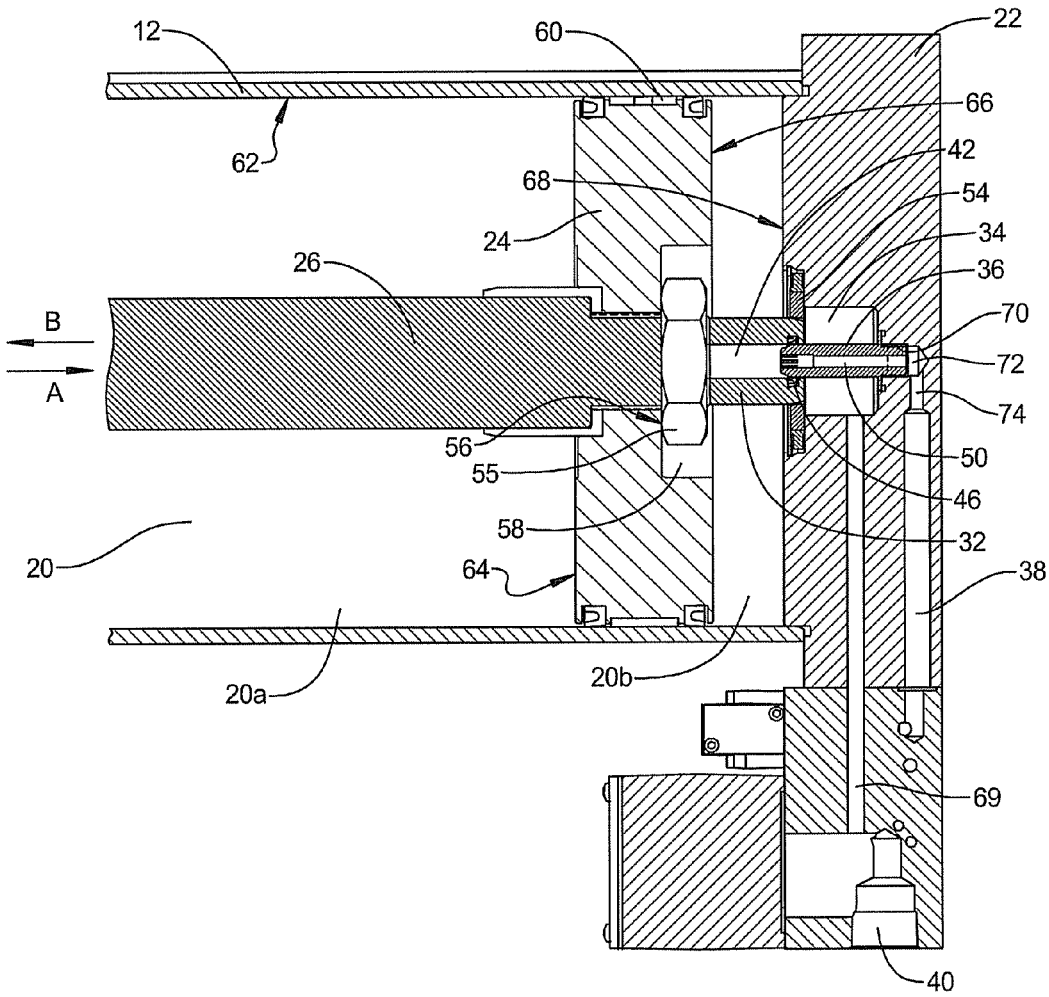
FIG. 4 is a cross sectional front elevational view taken at area 4 of FIG. 2.

Referring to FIG. 4, piston 24 is connected to piston rod 26 using a piston retention fastener such as a nut 55 which is threadably engaged with a threaded portion of piston rod 26. Piston retention nut 55 is threadably engaged until piston retention nut 55 contacts an end face 56 of a nut receiving counter bore 58 created in piston 24. A width or thickness of piston retention nut 55 is therefore substantially received within nut receiving counter bore 58. Piston 24 further includes a conductive seal 60 which is retained about a perimeter wall of piston 24 and slidingly contacts a cylinder inner wall 62 of cylinder 12 at any sliding position of piston 24. As piston 24 moves in either of the piston return direction "A" or piston drive direction "B", electrical contact is therefore maintained between cylinder 12, conductive seal 60, piston 24 and piston rod 26. The use of conductive seal 60 therefore obviates the need for a secondary connection between piston rod 26 and cylinder 12.

To displace piston 24 within piston chamber 20, a pressurized fluid such as pressurized air is introduced for example into first portion 20*a* which acts against a first piston face 64 displacing both piston 24 and piston rod 26 in the piston return direction "A". This displacement of piston 24 also co-displaces piston rod spud 32 into spud receiving bore 34. When piston rod spud 32 contacts and is sealingly engaged to tubular shaft 36 using first seal member 46, any fluid in central passage 50 and shaft receiving bore 42 is isolated from spud receiving bore 34. Therefore, as piston 24 continues to move in the piston return direction "A", fluid, such as pressurized air in second portion 20*b* of piston chamber 20, is compressed between a second piston face 66 and a head face 68 of second cylinder head 22. Pressurized air in shaft receiving bore 42 is therefore displaced via a flow path including central passage 50 and bore supply/vent passage 38. Pressurized air in spud receiving bore 34 is outwardly displaced via a pressure passage 69 in communication with spud receiving bore 34.

Tubular shaft 36 is connected to second cylinder head 22 using a male threaded end 70 of tubular shaft 36 which is threadably engaged in second cylinder head 22 in female threads created in a shaft receiving bore 72. Bore supply/vent passage 38 is open to shaft receiving bore 72 via a connecting passage 74.

Figure 5:
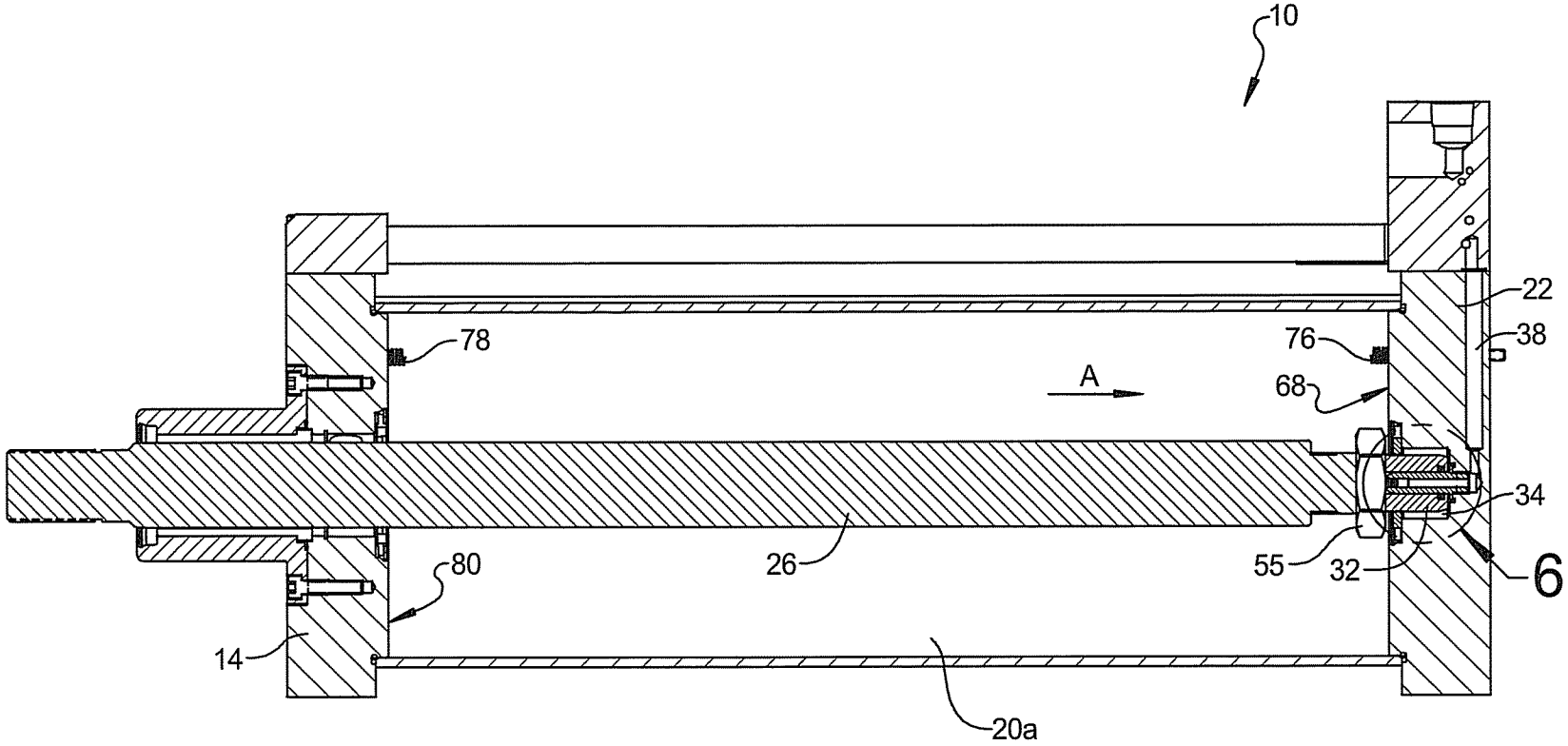
FIG. 5 is a cross sectional rear elevational view taken at section 5 of FIG. 1.

Referring to FIG. 5, piston 24 has been removed for clarity. When piston rod 26 had been displaced in the piston return direction "A" to the maximum extent, piston rod spud 32 is completely received within spud receiving bore 34 and piston retention nut 55 is positioned proximate to head face 68 of second cylinder head 22. To signal that the piston 24 is at the returned or first piston contact position, a switch having a first conductive biasing member 76 is contacted by second piston face 66 of piston 24, thereby completing an electrical circuit indicating contact by piston 24. A second switch having a second conductive biasing member 78 extends into piston chamber 20 from a head face 80 of first cylinder head 14. Contact between piston 24 and second conductive biasing member 78 would therefore create a second circuit signifying that piston 24 is at a piston second contact position with first cylinder head 14.

Figure 6:
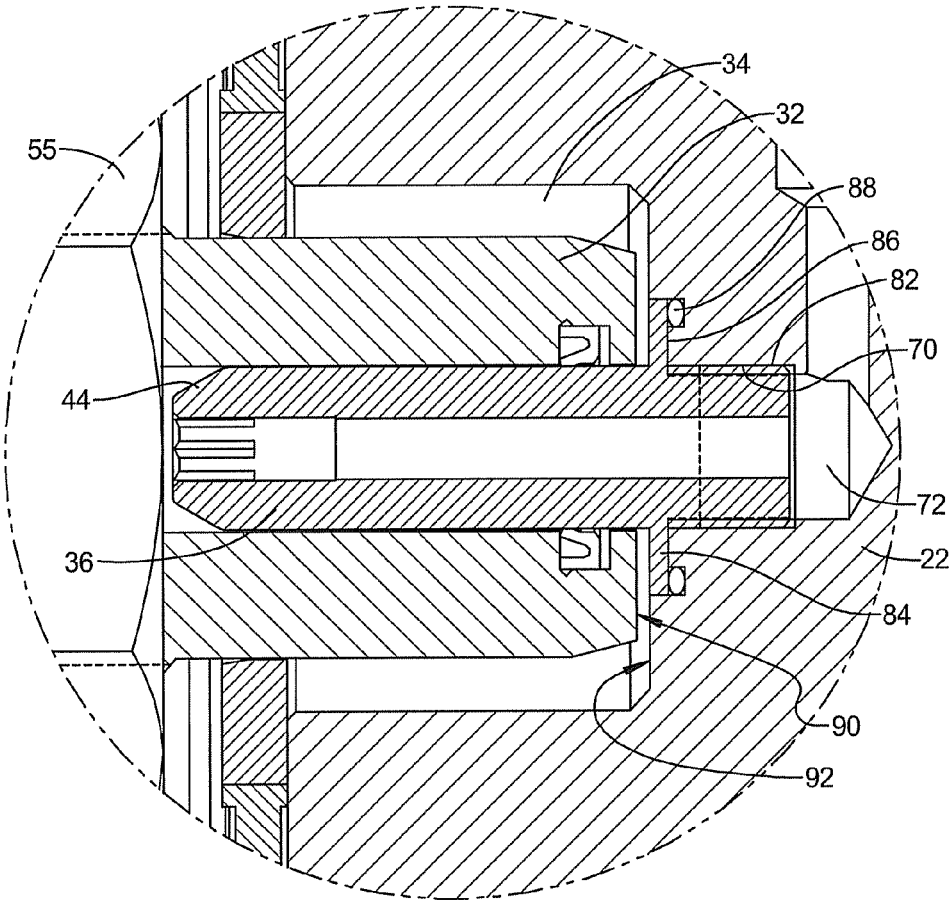
FIG. 6 is a cross sectional front elevational view taken at area 6 of FIG. 5.

Referring to FIG. 6, as previously noted, tubular shaft 36 includes male threaded end 70 which is threadably engaged with a threaded bore wall 82 of shaft receiving bore 72. To provide additional sealing capability, tubular shaft 36 can further include a radially extending flange 84 which contacts a flange contact face 86 created in second cylinder head 22 proximate to threaded bore wall 82. A second seal member 88, such as an O-ring or D-ring, can be positioned between flange 84 and flange contact face 86 to provide additional sealing capability. With piston rod spud 32 completely extending into spud receiving bore 34, a clearance can be maintained between a spud end face 90 of piston rod spud 32 and a bore end face 92 of spud receiving bore 34. This clearance permits physical contact between piston 24 and head face 68 of second cylinder head 22 as previously described in reference to FIG. 4.

Referring to FIG. 7 and again to FIGS. 1-6, piston rod and cylinder sealing device 10 can be used in conjunction with a crust breaker system 94. Crust breaker system 94 can include a pneumatic valve system 96 which is used to direct pressurized air into second portion 20*b* of piston chamber 20 to direct piston 24 in the piston drive direction "B" such that crust breaker rod 28 creates or maintains an aperture 98 through a crust layer 100 of an aluminum melt bath 102. Aluminum melt bath 102 is contained in a bath chamber 104. Aperture 98 is created through crust layer 100 in order to add additional chemicals such as alumina material to replenish aluminum melt bath 102.

Crust breaker system 94 can include a first pressure source 106 which can be aligned by control of a first control valve 108 and a second control valve 110 to direct pressurized air from first pressure source 106 via a first air supply/vent line 112 into first portion 20*a* of piston chamber 20 to hold piston 24 in the piston first contact position shown. To displace piston 24 in the piston drive direction "B", first and second control valves 108, 110 can be realigned such that pressurized air from a second pressure source 114 can be directed through an air delivery/vent line 116 and a second air supply/vent line 118 into spud receiving bore 34 to act on second piston face 66 while simultaneously first portion 20*a* is vented to atmosphere via a path including first air supply/vent line 112 and second control valve 110.

When piston rod spud 32 is fully received within spud receiving bore 34, air delivery/vent line 116 and second air supply/vent line 118 are both vented to atmosphere through second control valve 110. A valve position control line 120 which connects air delivery/vent line 116 to a first operating side of first control valve 108 is also vented to atmosphere at this time. Piston chamber 20 is therefore not pressurized to the full pressure range of first pressure source 106 because the vented valve position control line 120 directs first control valve 108 to isolate first pressure source 106 from piston chamber 20. Pressurized air in a third pressure source 122 maintains this position of first control valve 108 while maintaining a pressure in a pressure transfer line 124 which is connected to bore supply/vent passage 38 in second cylinder head 22. Pressure in pressure transfer line 124 also pressurizes shaft receiving bore 42 but does not provide enough force to overcome the air pressure in first portion 20*a* of piston chamber 20.

Pneumatic valve system 96 further includes a solenoid operated valve 126 which directs pressure from a fourth pressure source 128 to opposite ends of second control valve 110. By changing the orientation or position of solenoid operated valve 126, second control valve 110 can be positioned to pressurize either the first or second portion 20*a*, 20*b* of piston chamber 20. Electronic signals used to coordinate the positioning of solenoid operated valve 126 as well as feedback signals from contact between crust breaker rod 28 and aluminum melt bath 102 are received and/or generated using a control device 129.

Figure 7:
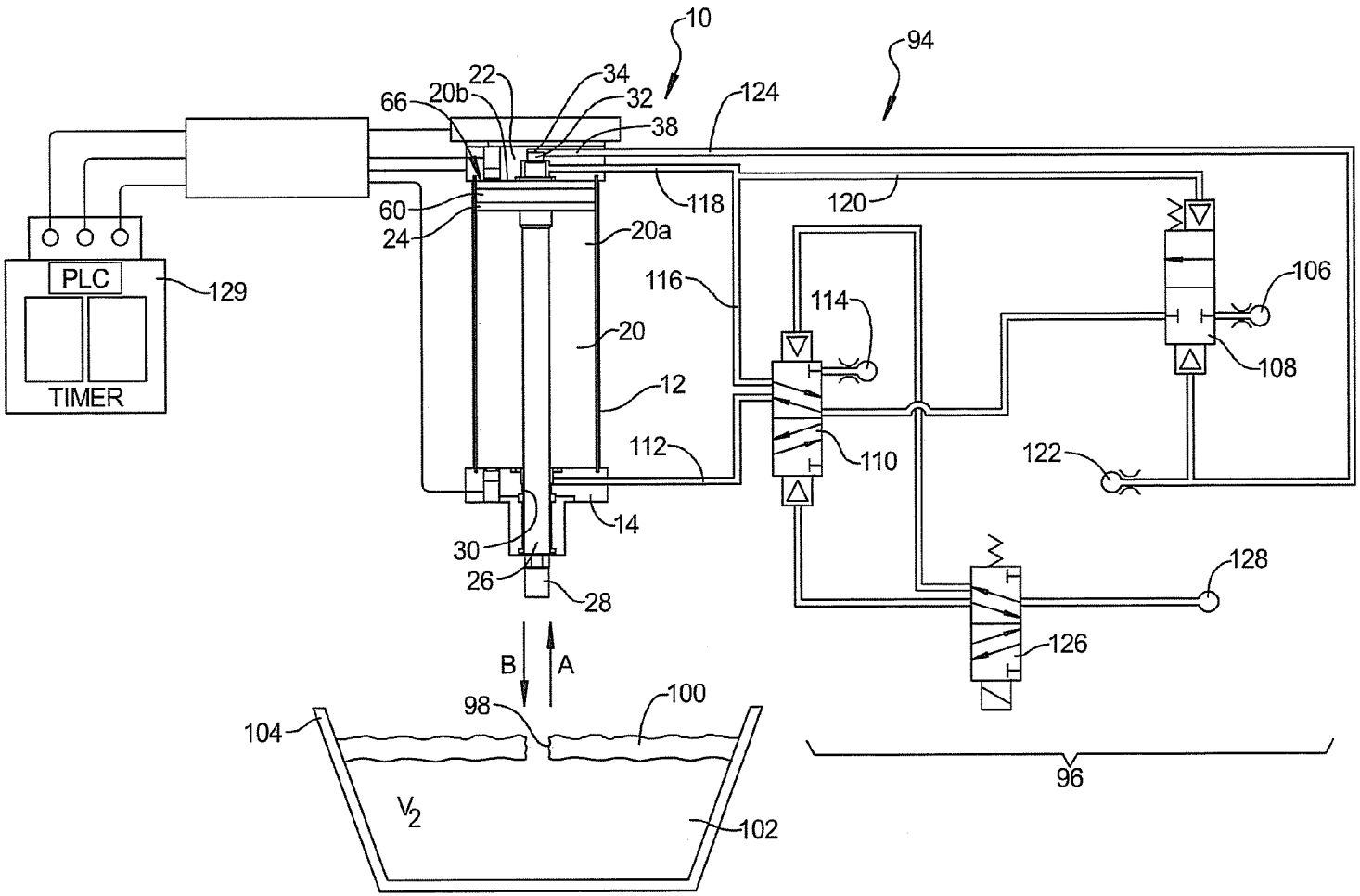
FIG. 7 is a system diagram of a crust breaking system having the piston rod and cylinder sealing device of FIG. 1.
Figure 8:
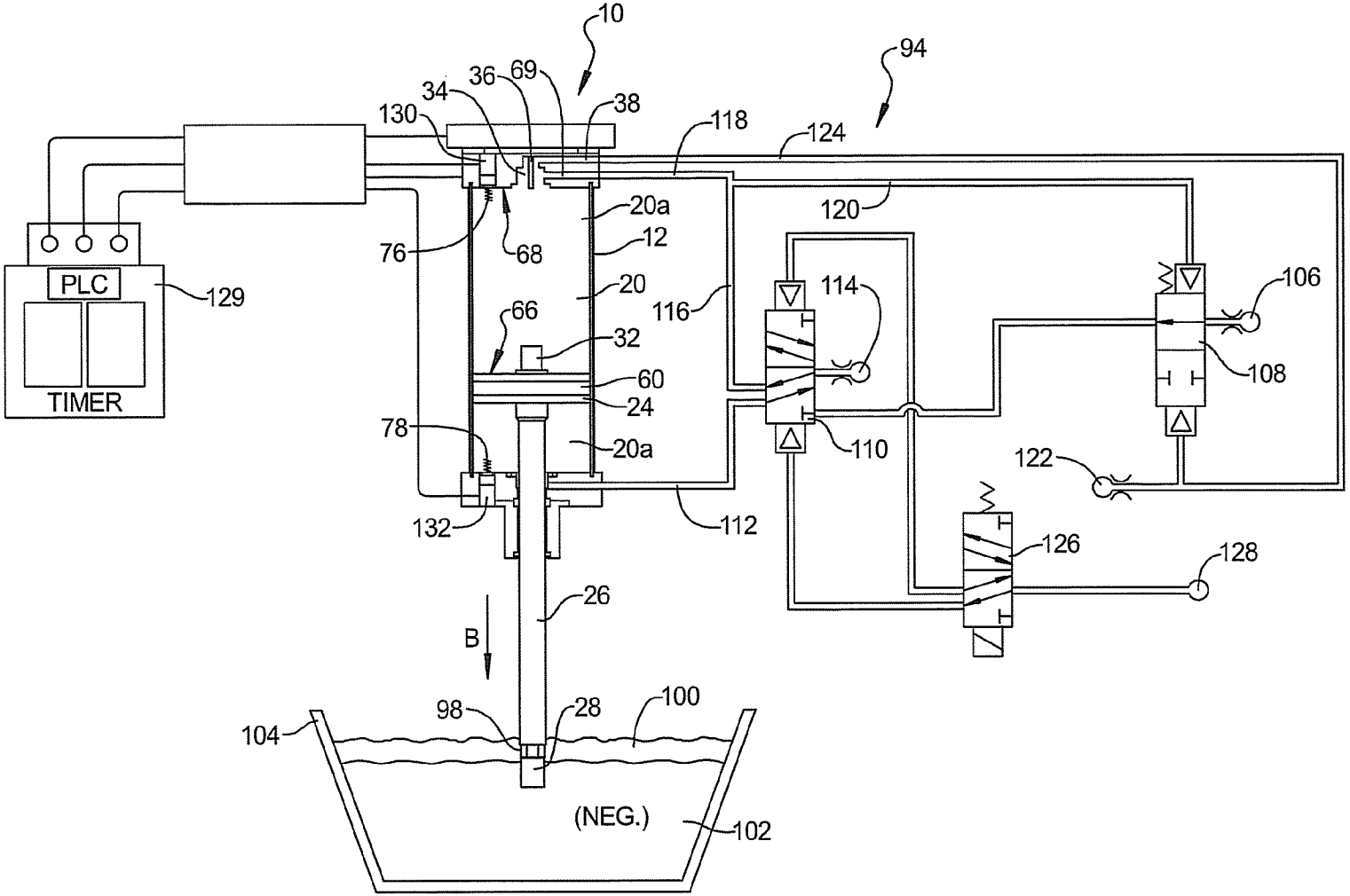
FIG. 8 is a system diagram of the crust breaking system of FIG. 8 showing the crust breaker rod after breaking through the crust layer.

Referring to FIG. 8 and again to FIG. 7, to displace piston 24 in the piston drive direction "B" and away from the piston first contact position shown in FIG. 7, second control valve 110 is repositioned using pressurized air from fourth pressure source 128 after reorienting solenoid operated valve 126 such that pressurized air from second pressure source 114 is aligned with air delivery/vent line 116 and second air supply/vent line 118 to pressurize second portion 20*b* of piston chamber 20. Simultaneously, first portion 20*a* of piston chamber 20 is vented to atmosphere by a path including first air supply/vent line 112 and second control valve 110. Pressurized air in second air supply/vent line 118 enters spud receiving bore 34, pushing piston rod spud 32 out of spud receiving bore 34 and further clearing a path for pressurized air in pressure transfer line 124 to enter second portion 20*b* via tubular shaft 36. The combination of these two pressure sources acts on second piston face 66 of piston 24 to displace piston 24 in the piston drive direction "B". With pressurized air in second air supply/vent line 118, valve position control line 120 is also pressurized, thereby repositioning first control valve 108 to align first pressure source 106 to the supply port of second control valve 110. The position of second control valve 110 temporarily prohibits pressurized air from first pressure source 106 from entering first portion 20*a* of piston chamber 20. It is noted that the pressure in valve position control line 120 together with a biasing member of first control valve 108 overcome the pressure from third pressure source 122 acting on an opposite end of first control valve 108. Therefore, even though pressurized air from third pressure source 122 flows through pressure transfer line 124, the biasing member of first control valve 108 provides the additional force required to reposition and hold first control valve 108 in the position shown.

As second piston face 66 of piston 24 displaces away from a contact position with first conductive biasing member 76, a first switch 130 having first conductive biasing member 76 connected thereto, opens a circuit signaling that piston 24 has left the piston first contact position with head face 68. When first piston face 64 of piston 24 second conductive biasing member 78, a second switch 132, having second conductive biasing member 78 connected thereto closes a circuit signaling that piston 24 is proximate to or has contacted first cylinder head 14, defining a piston second contact position. These circuit signals are received in control device 129.

When crust breaker rod 28 either creates or extends through aperture 98 of crust layer 100 and enters aluminum melt bath 102, a voltage $V_2$ of the aluminum melt bath 102 is sensed and conducted via an electrical path including crust breaker rod 28, piston rod 26, piston 24, conductive seal 60, cylinder 12 to control device 129. When the voltage $V_2$ of aluminum melt bath 102 is detected at control device 129, a signal is transmitted to reposition solenoid operated valve 126, which subsequently repositions second control valve 110. This position change of second control valve 110 isolates pressure from second pressure source 114 and providing a flow path for pressure from first pressure source 106 to re-enter first portion 20*a* of piston chamber 20. Piston 24 will thereafter return in the piston return direction "A" to the piston first contact position shown in FIG. 7. As piston rod spud 32 engages and seals against tubular shaft 36 pressurized air in pressure transfer line 124 is isolated from spud receiving bore 34, and second air supply/vent line 118 is vented to atmosphere, thereby repositioning first control valve 108. Piston rod spud 32, spud receiving bore 34, and tubular shaft 36 therefore provide the capability of redirecting pressurized air and/or venting pressurized air such that the position of first control valve 108 can be pneumatically operated and repositioned, eliminating the need for electronic control of either first or second control valves 108, 110.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A piston rod and cylinder seal device, comprising:

a cylinder creating a piston chamber extending between opposed first and second cylinder heads, a piston slidably disposed in the piston chamber, the piston having a piston rod connected to the piston;

a piston rod spud integrally connected to and extending from the piston rod, the piston rod spud including a shaft receiving bore;

a first seal member positioned in the shaft receiving bore; and a hollow tubular shaft connected to the second cylinder head and positioned in a spud receiving bore of the second cylinder head, the shaft aligned to be slidingly received in the shaft receiving bore and sealed by contact with the first seal member when the piston rod spud is received in the spud receiving bore and the piston contacts the second cylinder head, the shaft released from contact with the first seal member when the piston moves away from the second cylinder head withdrawing the piston rod spud from the spud receiving bore.

2. The piston rod and cylinder seal device of claim 1, wherein the second cylinder head includes the spud receiving bore, an air pressure passage communicating with the spud receiving bore, and a bore supply/vent passage communicating with a central passage of the shaft.

3. The piston rod and cylinder seal device of claim 2, wherein when the piston contacts the second cylinder head and the piston rod spud is slidingly received in the spud receiving bore pressurized air in the bore supply/vent passage communicating with the shaft is isolated by the first seal member from the air pressure passage communicating with the spud receiving bore.

4. The piston rod and cylinder seal device of claim 1, further including a shaft bore created in the second cylinder head receiving a threaded portion of the shaft.

5. The piston rod and cylinder seal device of claim 4, wherein the shaft bore includes a threaded bore wall, the threaded portion of the shaft threadably engaged with the threaded bore wall of shaft bore.

6. The piston rod and cylinder seal device of claim 1, wherein the shaft further includes a flange abutted against a flange contact face of the second cylinder head.

7. The piston rod and cylinder seal device of claim 6, further including a second seal member positioned between the flange and the flange contact face.

8. A piston rod and cylinder seal device, comprising:

a cylinder defining a piston chamber extending between opposed first and second cylinder heads, the second cylinder head having a spud receiving bore, an air pressure passage communicating with the spud receiving bore, and a bore supply/vent passage;

a piston slidably disposed in the piston chamber;

a piston rod connected to the piston, the piston rod having a piston rod spud including a blind shaft receiving bore; and a hollow tubular shaft connected to the second cylinder head and positioned in a spud receiving bore of the second cylinder head, the shaft having a central passage in communication with the bore supply/vent passage, the shaft sealingly received in the shaft receiving bore when the piston rod spud is slidingly received in the spud receiving bore thereby preventing pressurized air in the bore supply/vent passage from entering the spud receiving bore, the shaft positioned outside of the shaft receiving bore when the piston rod spud is outside of the spud receiving bore.

9. The piston rod and cylinder seal device of claim 8, further including a seal slot created in the shaft receiving bore.

10. The piston rod and cylinder seal device of claim 9, further including a seal member disposed in the seal slot and extending partially into the shaft receiving bore to sealingly engage the shaft.

11. The piston rod and cylinder seal device of claim 8, further including a cushion seal ring connected to the second cylinder head creating an annular passage between the cushion seal ring and the piston rod spud when the piston rod spud is received in the spud receiving bore.

12. The piston rod and cylinder seal device of claim 11, further including a portion of the piston chamber between the piston and the second cylinder wall, wherein the portion of the piston chamber is in fluid communication with a flow path including the annular passage, the spud receiving bore and the air pressure passage after the shaft is sealingly received in the shaft receiving bore.

13. The piston rod and cylinder seal device of claim 8, wherein the second cylinder head further includes a first switch having a first conductive biasing member extending into the piston chamber, the piston contacting the first conductive biasing member when the piston contacts the second cylinder head.

14. The piston rod and cylinder seal device of claim 13, wherein the first cylinder head includes a second switch having a second conductive biasing member extending into the piston chamber, the piston contacting the second conductive biasing member when the piston contacts the first cylinder head.

15. The piston rod and cylinder seal device of claim 8, further including a portion of the piston chamber between the piston and the second cylinder wall, wherein the portion of the piston chamber is in fluid communication with the spud receiving bore, the air pressure passage and the bore supply/vent passage when the piston rod spud is outside of the spud receiving bore.

* * * * *